US011486371B2

(12) United States Patent
Pucci

(10) Patent No.: US 11,486,371 B2
(45) Date of Patent: Nov. 1, 2022

(54) HALL THRUSTER WITH ANNULAR CATHODE

(71) Applicant: Aerojet Rocketdyne, Inc., Sacramento, CA (US)

(72) Inventor: Justin Pucci, Bothell, WA (US)

(73) Assignee: AEROJET ROCKETDYNE, INC., Redmond, WA (US)

( * ) Notice: Subject to any disclaimer, the term of this patent is extended or adjusted under 35 U.S.C. 154(b) by 154 days.

(21) Appl. No.: 16/771,026

(22) PCT Filed: Dec. 19, 2017

(86) PCT No.: PCT/US2017/067237

§ 371 (c)(1),
(2) Date: Jun. 9, 2020

(87) PCT Pub. No.: WO2019/125405

PCT Pub. Date: Jun. 27, 2019

(65) Prior Publication Data

US 2021/0164453 A1 Jun. 3, 2021

(51) Int. Cl.
*F03H 1/00* (2006.01)

(52) U.S. Cl.
CPC ..... *F03H 1/0037* (2013.01)

(58) Field of Classification Search
CPC .... F03H 1/0062; F03H 1/0068; F03H 1/0075; F03H 1/0037; B64H 1/405
See application file for complete search history.

(56) References Cited

U.S. PATENT DOCUMENTS

| | | | | |
|---|---|---|---|---|
| 7,180,243 | B2 * | 2/2007 | Secheresse | F03H 1/0075 315/111.21 |
| 7,637,461 | B1 | 12/2009 | Spanjers | |
| 2006/0218891 | A1 | 10/2006 | Roy | |
| 2009/0058305 | A1 * | 3/2009 | Hofer | H01J 3/027 315/111.91 |

OTHER PUBLICATIONS

Wikipedia. Hall-effect thruster. Retrieved Aug. 31, 2018 from: https://en.wikipedia.org/dindex.php?title:Hall-effect_thruster &oldid:814284147.
International Search Report for International Patent Application No. PCT/US2017/067237 completed Aug. 31, 2018.
International Preliminary Report on Patentability for International Application No. PCT/US2017/067237 dated Jul. 2, 2020.

* cited by examiner

*Primary Examiner* — Ehud Gartenberg
*Assistant Examiner* — William L Breazeal

(57) ABSTRACT

A Hall thruster includes an annular discharge region and an annular cathode concentric to the annular discharge region.

8 Claims, 2 Drawing Sheets

HALL THRUSTER WITH ANNULAR CATHODE

BACKGROUND

Ion accelerators with closed electron drift are also known as Hall-effect thrusters or Hall thrusters. Hall thrusters can be used on space vehicles for propulsion, station-keeping, orbit changes, or counteracting drag, for example. Hall thrusters generate thrust by supplying a propellant gas to an annular channel. The annular channel has a closed end with an anode and an open end through which the gas is discharged. A cathode introduces free electrons into the area of the open end. The electrons are induced to drift circumferentially in the annular channel by a generally radially extending magnetic field in combination with a longitudinal electric field, but the electrons eventually migrate to the anode. The electrons collide with the gas atoms to create ions. The longitudinal electric field accelerates the ions from the open end of the annular channel to generate a reaction force that produces thrust. In general, Hall thrusters come in wide range of discharge power configurations.

SUMMARY

A Hall thruster according to an example of the present disclosure includes an annular discharge region and an annular cathode concentric to the annular discharge region.

In a further embodiment of any of the foregoing embodiments, the annular cathode is circumscribed by the annular discharge region.

In a further embodiment of any of the foregoing embodiments, the annular cathode circumscribes the annular discharge region.

A further embodiment of any of the foregoing embodiments include an anode adjacent the annular discharge region.

A Hall thruster according to an example of the present disclosure includes inner and outer magnetic poles, and an annular discharge region between the inner and outer magnetic poles. The annular discharge region defines a central axis. A propellant gas feeder is operable to feed propellant gas to the annular discharge region. An annular cathode circumscribes the central axis, an anode, and at least one magnet magnetically coupled with the inner and outer magnetic poles to generate a magnetic field across the annular discharge region.

In a further embodiment of any of the foregoing embodiments, the annular cathode is circumscribed by the annular discharge region.

In a further embodiment of any of the foregoing embodiments, the annular cathode circumscribes the annular discharge region.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
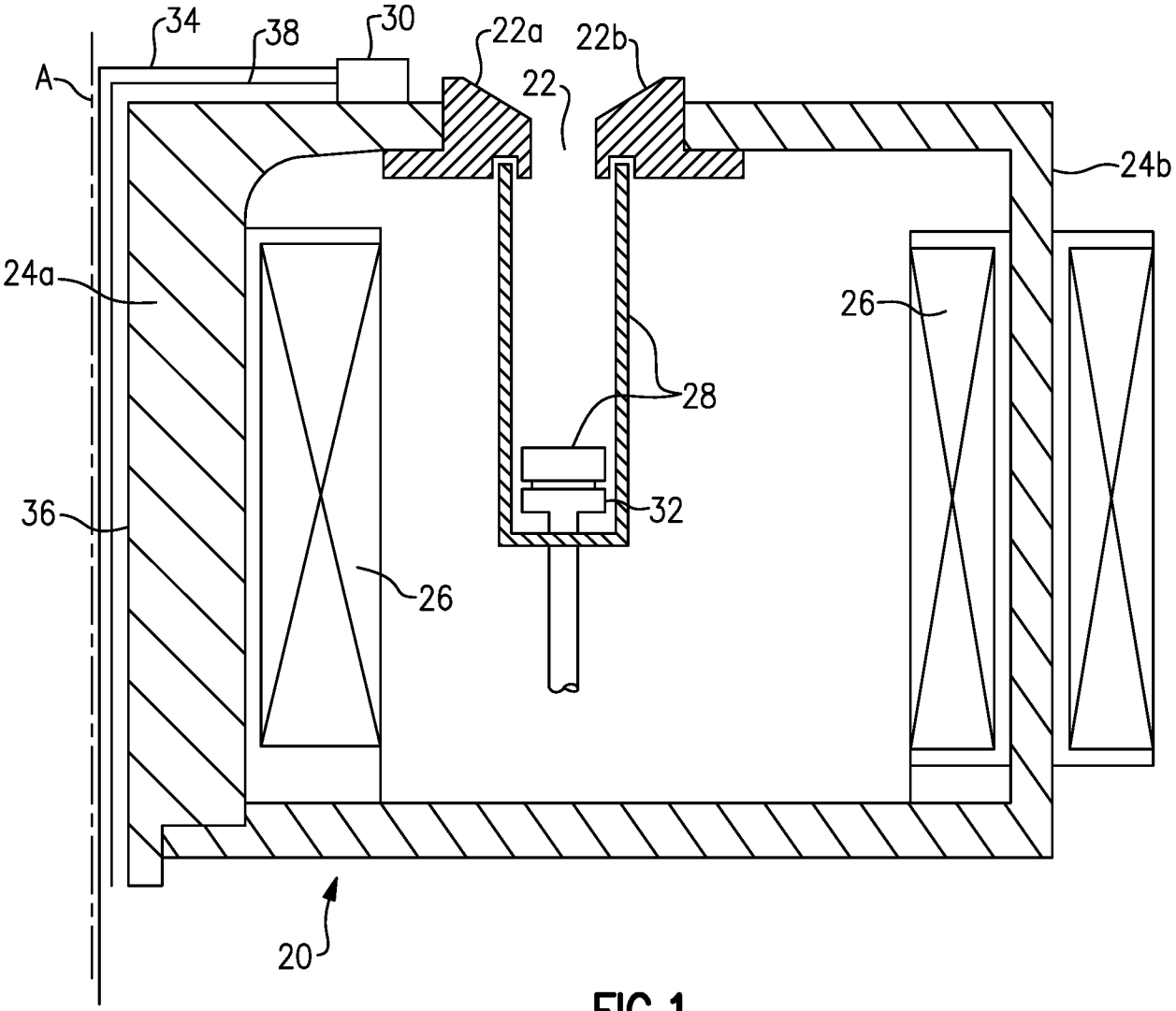
FIG. 1 illustrates an example Hall thruster, with an annular cathode circumscribing the annular discharge region.

FIG. 1 schematically illustrates a sectioned view of an example Hall thruster 20, which is symmetric about central axis A. As will be appreciated, to the extent that there are components or functions of the Hall thruster 20 that are not shown or described herein, given this disclosure, such components and functions are known and will be evident to those of ordinary skill in the art.

The Hall thruster 20 generally includes a discharge region 22. In this example, the discharge region 22 is defined between inner and outer rings 22*a*/22*b*. The inner and outer rings 22*a*/22*b* circumscribe the central axis A and the discharge region 22 thus also circumscribes the central axis A. In the illustrated example, the inner and outer rings 22*a*/22*b*, and the discharge region 22, are annular. As used herein, the term "annular" or variations thereof refers to a closed-loop or circular ring shape. As will be appreciated, the circular nature may not be perfectly circular due to tolerances and the like or may take another closed-loop shape such as an oval, ellipse, or other.

In the illustrated example, the inner and outer rings 22*a*/22*b* are individual piece-parts; however, a singular dielectric discharge channel structure may be disposed in place of individual rings. The inner and outer rings 22*a*/22*b* are attached, respectively, with inner and outer magnetic poles 24*a*/24*b*. The discharge region 22 is thus also radially between the poles 24*a*/24*b*. The poles 24*a*/24*b* are formed of a ferromagnetic material. There is at least one magnet 26 that is magnetically coupled with the poles 24*a*/24*b* to form a magnetic circuit. The magnet 26 can be a permanent magnet or an electro-magnet. The magnetic circuit provides a magnetic field radially across the discharge region 22 and in the vicinity thereof.

The Hall thruster 20 also includes an anode 28, which is may be disposed within the discharge region 22, and a cathode 30 that is also adjacent the discharge region 22. The cathode 30 circumscribes the central axis A. Most typically, as in the illustrated example, the cathode 26 is an annular cathode.

The Hall thruster 20 also includes a propellant gas feeder 32. In this example, the feeder 32 is situated near the anode 28 and is operable to emit propellant gas, such as xenon, to the discharge region 22 and vicinity thereof. The feeder 32 may include nozzles, gas distributors, plenums, or the like for directing the propellant gas. The feeder may be fluidly connected in a feed system to a propellant gas storage tank or the like.

The cathode 30 is radially inward of the discharge region 22. Thus, all locations around the cathode 30, such as around the radially outer surface, are substantially equidistant from the nearest location of the discharge region 22. The shape and symmetry of the cathode 30, and the relatively close proximity of the cathode 30 to the discharge channel, provide improved coupling of the cathode electrons into the discharge channel and the opportunity for greater efficiency in comparison to a singular external cathode that is typically located remotely from the discharge channel. The shape, symmetry, and proximity of the cathode 30 also provides a simplified design, which may result in lower mass and smaller design envelope.

The cathode 30 receives power via a power line 34. In the example, the power line 34 is routed through the Hall thruster 20 radially inside of the discharge region 22. As shown, the inner magnetic pole 24*a* includes a passage 36 along the central axis A. The power line 34 is routed through the passage 36 to a power source (not shown). The routing of the power line 34 through the Hall thruster 20 inwards of the discharge region 22 avoids routing the line 34 over the discharge region 22.

The cathode 30 may be propellant-fed or propellant-less. A propellant-less cathode relies entirely on a thermionic emitter material to produce electrons and has limited current capability. A propellant-fed cathode is capable of providing higher current, by using additional propellant gas that it ionizes to support the demanded electron current to the discharge region 22. As shown, the cathode 30 is propellant-fed and includes a propellant gas line 38. The propellant gas line 38 may be fluidly connected with a propellant gas source and/or the feed system that also provides propellant gas to the feeder 32. Like the power line 34, the propellant gas line 38 is routed through the passage 36 in the pole 24*a*. Alternatively, if the cathode 30 is propellant-less, the line 38 is excluded.

Figure 2:
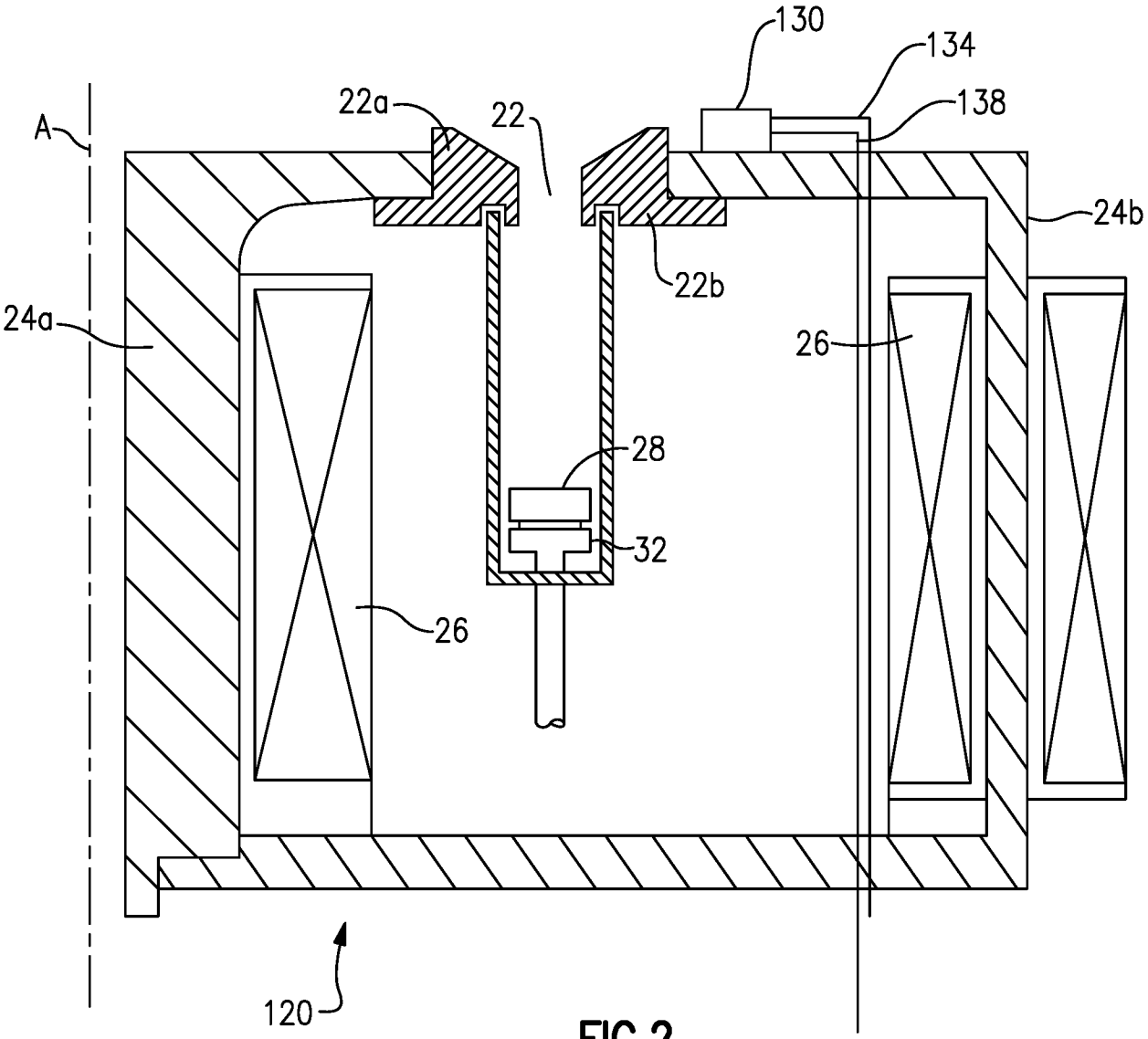
FIG. 2 illustrates another example Hall thruster, with an annular cathode circumscribed by the annular discharge region.

FIG. 2 illustrates another example Hall thruster 120. In this disclosure, like reference numerals designate like elements where appropriate and reference numerals with the addition of one-hundred or multiples thereof designate modified elements that are understood to incorporate the same features and benefits of the corresponding elements. In this example, the cathode 130 is located radially outside of the discharge region 22. Although the size of cathode 130 would be somewhat larger than the cathode 30, the cathode 130 is still located relatively close to the discharge region 22 and equidistant therefrom.

In this example, the power line 134 and propellant gas line 138 (if the cathode 130 is propellant-fed design) are routed through the Hall thruster 120 radially outside of the discharge region 22. For instance, the power line 134 and propellant gas line 138 are routed through the outer magnetic pole 24*b* to, respectively, a power source and gas source (not shown).

Although specific combinations of features are shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A Hall thruster comprising:

a magnetic pole disposed about a central axis;

a passage along the central axis through the magnetic pole;

an annular discharge region;

an anode, wherein at least a portion of the anode is disposed in the annular discharge region; and an annular cathode in the form of a ring concentric to the annular discharge region around the central axis, wherein the annular cathode is radially inwardly displaced from the annular discharge region and radially outwardly displaced from the passage.

2. The Hall thruster as recited in claim 1, wherein the annular cathode is circumscribed by the annular discharge region.

3. The Hall thruster as recited in claim 1, further comprising another portion of the anode surrounding the annular discharge region.

4. The Hall thruster as recited in claim 1, wherein the annular cathode is circumscribed by the annular discharge region.

5. The Hall thruster as recited in claim 1, wherein a radially outer surface of the ring is substantially equidistant from the discharge region.

6. The Hall thruster as recited in claim 1, wherein the anode and the annular cathode are electrically coupled to generate an electric field there between and induce electrons to drift into the annular discharge region.

7. A Hall thruster comprising:

a radially inner magnetic pole and a radially outer magnetic pole, wherein the radially inner magnetic pole and the radially outer magnetic pole are disposed about a central axis;

a passage along the central axis through the radially inner magnetic pole;

an annular discharge region between the radially inner magnetic pole and the radially outer magnetic pole;

a propellant gas feeder operable to feed propellant gas to the annular discharge region;

an annular cathode in the form of a ring concentric to the annular discharge region around the central axis, wherein the annular cathode is radially inwardly displaced from the annular discharge region and radially outwardly displaced from the passage;

an anode disposed in the annular discharge region; and at least one magnet magnetically coupled with the radially inner magnetic pole and the radially outer magnetic pole to generate a magnetic field across the annular discharge region.

8. The Hall thruster as recited in claim 7, wherein the annular cathode is circumscribed by the annular discharge region.

* * * * *